United States Patent [19]

Fulenwider, Jr.

[11] 4,064,852

[45] Dec. 27, 1977

[54] MICROWAVE ENERGY APPARATUS AND METHOD FOR INTERNAL COMBUSTION ENGINES

[76] Inventor: Hal Fulenwider, Jr., P.O. Box 971, Palm Beach, Fla. 33480

[21] Appl. No.: 774,167

[22] Filed: Mar. 3, 1977

Related U.S. Application Data

[63] Continuation of Ser. No. 629,374, Nov. 6, 1975, abandoned.

[51] Int. Cl.[2] ..... F02M 27/04

[52] U.S. Cl. ..... 123/119 E; 123/25 B; 123/122 F; 123/141

[58] Field of Search ..... 123/141, 119 E, 119 EE, 123/122 F, 25 B, 25 D, 148 E

[56] References Cited

U.S. PATENT DOCUMENTS

| | | | |
|---|---|---|---|
| 1,939,302 | 12/1933 | Heaney | 123/119 E |
| 2,402,539 | 6/1946 | Eitel | 123/148 E |
| 2,617,841 | 11/1952 | Linder | 123/148 E |
| 2,704,535 | 3/1955 | Magui et al. | 123/119 E X |
| 2,791,990 | 5/1957 | Grieb | 123/119 EE |
| 2,791,994 | 5/1957 | Grieb | 123/119 EE |
| 2,876,270 | 3/1959 | Lutz | 123/148 E |
| 2,907,648 | 10/1959 | Chapman | 123/119 EE X |
| 3,934,566 | 1/1976 | Ward | 123/148 E X |
| 3,976,726 | 8/1976 | Johnson | 123/119 E X |

*Primary Examiner*—Charles J. Myhre
*Assistant Examiner*—Ira S. Lazarus

[57] ABSTRACT

A device for vaporizing and heating a liquid for use in an internal combustion engine by subjecting the liquid to radio frequency microwave energy before introduction into the engine cylinders and the method therefor.

12 Claims, 4 Drawing Figures

MICROWAVE ENERGY APPARATUS AND METHOD FOR INTERNAL COMBUSTION ENGINES

This is a continuation of application Ser. No. 629,374 filed Nov. 6, 1975 now abandoned.

BACKGROUND, ADVANTAGES AND OBJECTIVES OF THE INVENTION

Within recent years the realization of the reliance upon petroleum products for energy has results in a more conscious awareness of the substantial consumption and inefficiency of the internal combustion engine, the high cost of gasoline, and the reliance upon petroleum imports as well as the environmental problems that have been publicized through ecological movements. A broad range of devices for increasing mileage, decreasing fuel consumption and removing pollutants from the atmosphere have been goals sought to be achieved by governmental controls, consumers and environmentalists.

Various types of carburetors have been designed with the objective of increasing mileage and decreasing fuel consumption. Ultrasonic acoustic energy has been employed in combination with various types of carburation to improve engine performance and fuel economy. Various types of heating means and vaporization means have been conceived to improve engine performance and fuel economy as well as to utilize various types of fuels and to formulate combustible mixtures which include water or water vapor.

It has been determined that by the utilization of radio frequency energy waves produced through microwave energy propagation that liquids may be volatilized and heated preliminary to introduction into the cylinders of an internal combustion engine for improving fuel consumption by what is considered to be a superior means for virtually instantaneous volatilization and heating of liquids within a controlled zone to generate a more intimate heated combustible mixture. Mileage on a standard automobile has been increased at least 50 percent in many extended tests by utilizing a mixture of gasoline and water which mixture has been subjected initially to microwave energy to volatilize and heat the mixture. Pollutants have been reduced and no adverse engine deterioration or maintenance has been experienced.

Therefore, it is an objective of this invention to provide a high frequency microwave system to volatilize and heat liquid for use in internal combustion engines to improve fuel consumption and mileage.

Another objective of this invention is to provide a magnetron for propagating microwave energy to volatilize and heat a liquid which may include water or a mixture of a hydrocarbon and water for consumption in an internal combustion engine.

Yet another objective of this invention is the provision of a method for vaporizing and heating liquid for combustion in an internal combustion engine by subjecting liquid to be used in combustion to the high level of microwave energy before introduction into the combustion chamber.

A further objective of this invention is the provision of a readily convertible adaptation and installation of a radio frequency microwave unit and associated components to a standard internal combustion engine as well as to new engines with minimum modifications at reasonable expense.

Other objectives and many of the advantages of this invention will become more readily apparent to those skilled in the art from the following detailed description of the apparatus and from the method taken in conjunction with the accompanying drawing in which like characters of reference designate corresponding parts throughout the several views. It will be readily apparent also that many modifications may be made to the type of magnetron or microwave energy unit and power supply employed as well as the specific component orientation.

DESCRIPTION OF THE DRAWING OF A PREFERRED EMBODIMENT

DESCRIPTION OF A PREFERRED EMBODIMENT OF THE APPARATUS AND METHOD

Figure 1:
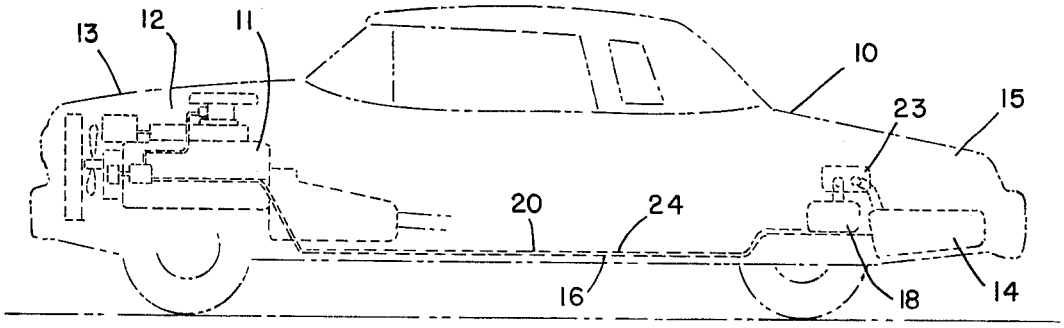
FIG. 1 is a side elevational view of an automobile having an internal combustion engine and an electrical power supply in the luggage compartment for supplying power to the magnetron or microwave unit supported in the engine compartment.
Figure 2:
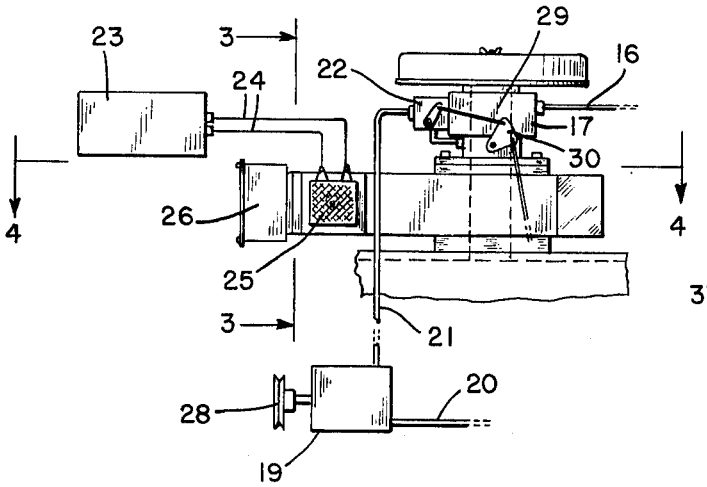
FIG. 2 is a diagramatic illustration of the fuel supply or intake relative to the microwave unit and wave guide assembly.

Referring to the drawing and particularly to FIG. 1, there is shown a conventional automobile 10 driven by a conventional internal combustion engine 11 mounted in the forward engine compartment 12 under the hood 13. A gasoline tank 14 is supported in a conventional manner beneath the trunk compartment 15 on the underside rear of the vehicle from which a fuel supply line 16 transmits fuel from the tank 14 to a conventional fuel pump to the carburetor 17. A separate water reservoir 18 is provided in the rear trunk compartment to supply water to the water pump 19 through the line 20. Water is pumped by the water pump 19 through the line 21 to the water intake section 22 of the carburetor 17.

Figure 3:
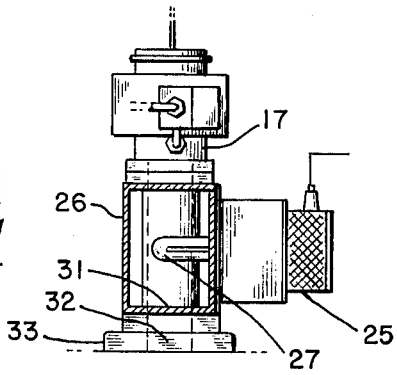
FIG. 3 is a slightly enlarged partial sectional view, with portions omitted, of the magnetron, antenna, wave guide and carburetor.
Figure 4:
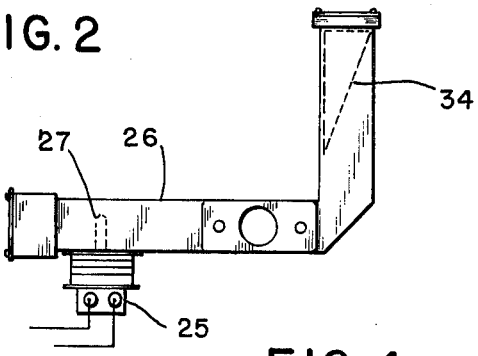
FIG. 4 is a partial top plan view of the magnetron and wave guide taken substantially along the line 4—4 of FIG. 2.

A compact electrical power supply system 23 which may be in the form of a motor-generator set supplies electrical energy through a separate conduit 24 to the magnetron 25 that is installed adjacent to one end of a L-shaped wave guide 26 that is appropriately shielded against any possible harmful emissions. The microwave antenna 27 is positioned within the wave guide housing directly beneath the carburetor 17 as shown in FIG. 3.

Gasoline or other suitable hydrocarbon fuel in liquid form will be supplied through conventional means to the inlet of the carburetor and water or a mixture of water and alcohol or alcohol, whether isopropyl, methyl or ethyl, may be supplied to the carburetor depending upon climatic conditions and availability. The water pump 19 may be driven from the pulley 28 that is driven by a belt connected either to the generator or fan shaft. In the illustrated embodiment, gasoline and water enter the carburetor chamber 29 in controlled amounts depending upon load demand in a conventional manner. Upon introduction and flow of the gasoline and water into the chamber 29, the mixture will pass downwardly into the wave guide housing 26 in which radio frequency microwave energy will vaporize and heat the mixture as it flows downwardly through the discharge port 31 in the housing 26 and into the inlet port 32 of the inlet manifold 33 before passage to the individual cylinders for combustion in the engine. Dissipation of the microwave energy in excess of that required will occur in the L-shaped section 34 of the wave guide assembly 26. Supplemental absorption may be provided in addition to shielding as required for safety precautions.

A magnetron employed in a domestic microwave oven has been utilized in one embodiment in which the magnetron or microwave unit required 110 volts which was obtained from a small gasoline driven generator set 23. It is contemplated that a microwave unit will be installed in which the power supply will come directly from the generator at the appropriate voltage supply required to achieve the same or substantially the same result obtained using the microwave unit supplied with 110 volt electrical current. The optimum radio frequency or energy from the microwave unit to achieve the most desirable results is not presently known for the full range of hydrocarbon fuels, water or alcohols which may vary depending upon the specific fuels and other liquids utilized.

However, it has been determined that the supply of microwave energy may be directed to the combustible hydrocarbon alone preliminary to introduction into the engine or the gasoline may be introduced separately from the water to be supplied in which case the water may be subjected to the microwave energy prior to mixing with the combustible hydrocarbon before introduction into the manifold as the mixture flows to the combustion chambers of the engine.

It has been determined also that should any defect occur in connection with the magnetron unit, the engine will function in its normal manner without operating the magnetron unit but the vaporization and heating of the combustible mixture will not occur.

The precise range or radio frequency for each specific liquid has not been determined at the present time but the utilization of the domestic magnetron unit from a microwave oven has been found to be highly satisfactory for test purposes in the installation in a test vehicle in which the mileage has been increased from conventional operation in excess of 50 percent for extended periods of operation under normal highway conditions in which the vehicle has been run at the same speeds without and with the utilization of the microwave unit installation. Substantial reduction in pollutants has also been determined presumably by reason of the substantially lower fuel consumption but the actual reasons have not been fully determined.

The use of water in the carburetor for mixing with the gasoline or other hydrocarbon fuel to form a combustible mixture may have to be modified during cold weather by the use of or addition of a suitable alcohol to prevent freezing. Furthermore, alcohol may be utilized in place of water in conjunction with the hydrocarbon fuel to achieve a desirable combustion mixture.

It is further contemplated that separate magnetrons may be utilized in parallel, if desirable, depending upon the number of carburetors that are being used or to have a common microwave guide housing through which all combustible mixtures may be subjected before introduction into one or more intake manifolds.

I claim:

1. A device for vaporizing and heating liquid in combination with an internal combustion engine having inlet means to cylinders for combustion comprising means for supplying liquid to said inlet means, and microwave generating means for subjecting said liquid to microwave energy to volatilize and heat said liquid for combustion prior to entry by said liquid into said cylinders, substantially L shaped wave guide means for directing said microwave energy from said generating means to said inlet means and for dissipating excess microwave energy.

2. A device for vaporizing and heating liquid as claimed in claim 1, said liquid including at least some combustible hydrocarbons.

3. A device for vaporizing and heating liquid as claimed in claim 1, said liquid including water.

4. A device for vaporizing and heating liquid as claimed in claim 1, said liquid including a combustible mixture of hydrocarbons and water.

5. A device for vaporizing and heating liquid as claimed in claim 1, said liquid including a combustible mixture of hydrocarbons, water and alcohol.

6. A device for vaporizing and heating liquid as claimed in claim 1, and wave guide means directing said microwave energy from said generating means to said inlet means.

7. A device for vaporizing and heating liquid as claimed in claim 1, and means shielding said microwave generating means at least partially.

8. A method of vaporizing and heating liquid for combustion in an internal combustion engine comprising the steps of supplying a liquid to the intake of said engine, generating microwave energy, subjecting said liquid to said microwave energy for volatilization and heating prior to entry of said liquid into said engine before combustion in said engine, and dissipating excess microwave energy generated.

9. A method of vaporizing and heating liquid as claimed in claim 8, and controlling the propagation of said microwave energy to said liquid supply.

10. A method of vaporizing and heating liquid as claimed in claim 8, wherein said liquid is a combustible mixture containing at least some hydrocarbons.

11. A method of vaporizing and heating liquid as claimed in claim 8, wherein said liquid includes water.

12. A method of vaporizing and heating liquid as claimed in claim 8, wherein said liquid is a combustible mixture containing at least some hydrocarbons, water, and alcohol.

* * * * *